US008043176B2

(12) United States Patent
Byrne

(10) Patent No.: US 8,043,176 B2
(45) Date of Patent: Oct. 25, 2011

(54) ROTARY ARROWHEAD ASSEMBLY

(75) Inventor: Timothy E. Byrne, Flint, MI (US)

(73) Assignees: Timothy Byrne, Flint, MI (US); Dom Byrne, Flint, MI (US)

( * ) Notice: Subject to any disclaimer, the term of this patent is extended or adjusted under 35 U.S.C. 154(b) by 479 days.

(21) Appl. No.: 12/169,472

(22) Filed: Jul. 8, 2008

(65) Prior Publication Data

US 2010/0009789 A1 Jan. 14, 2010

(51) Int. Cl.
*F42B 6/08* (2006.01)

(52) U.S. Cl. ..... 473/578

(58) Field of Classification Search ..... 473/583, 473/584

See application file for complete search history.

(56) References Cited

U.S. PATENT DOCUMENTS

| | | | | |
|---|---|---|---|---|
| 4,671,517 | A * | 6/1987 | Winters | 473/583 |
| 4,781,386 | A * | 11/1988 | Armitage | 473/584 |
| 5,257,809 | A * | 11/1993 | Carrizosa | 473/584 |
| 5,496,042 | A * | 3/1996 | Craft et al. | 473/583 |
| 7,338,397 | B2 * | 3/2008 | Mizek et al. | 473/583 |
| 2006/0030438 | A1 * | 2/2006 | Hajek | 473/583 |

* cited by examiner

*Primary Examiner* — John Ricci
(74) *Attorney, Agent, or Firm* — Jay Schloff

(57) ABSTRACT

An arrowhead assembly includes a blade tube that may rotate in flight at a rate during flight that is independent from the arrow shaft rotation. The assembly, upon and after impact with the target, continues rotational motion of the blade tube to penetrate a substantial distance into the target. Such characteristics are facilitated by the spiral-shaped, or twisting, nature of the blades as well as the rotational motion that is imparted by a spring arrangement of the assembly after compression and expansion of the spring arrangement upon impact.

11 Claims, 8 Drawing Sheets

ROTARY ARROWHEAD ASSEMBLY

FIELD

The present invention relates generally to arrowhead assemblies for use in bow-and-arrow target shooting and hunting; and, more specifically, to an improved broadhead-type arrowhead assembly having improved flight and performance characteristics achieved through the use of curved blades and rotational motion occurring during flight and continuing after impact of the arrowhead assembly.

BACKGROUND

A bow and arrow arrangement is a popular form of hunting game. The arrangement allows for improved accuracy and a quieter presence in the field as opposed to hunting with a rifle or a shotgun. An arrow typically comprises an arrowhead assembly with a pointed or tapered end and a shaft, an end of which shaft engages with a tension wire arrangement on the bow. A user may draw the shaft against the tension wire arrangement, and thereafter release the shaft, which propels the arrow away from the bow and the user after the tension wire arrangement returns to its rest position.

Arrowhead assemblies (also referred to herein as "broadheads") of arrows known in the art usually have straight blades that are in-line with regard to the shaft of the arrow. In this configuration, the arrow may rotate in flight after it is propelled away from the bow. However, the rotational motion will cease upon or shortly after impact on a target. Accordingly, upon striking a target, only the arrow's linear momentum will carry the arrow into the target. In such a case, the arrow may exit the mass of the target after entry. In the case where wild game is the target, the exiting of the arrow will decrease the probability that the game will be felled or killed by the arrow, and that the game will only be injured by the arrow. However, the game most likely will eventually bleed to death, which delay is an inhumane end to the game's life.

Attempts have been made to improve the rotational motion of an arrow and arrowhead assembly after the user has released the arrow from the bow, however, these attempts do not solve the problem of the cessation of rotational motion after impact of the arrowhead assembly.

Accordingly, there exists a need for an arrowhead assembly, and more specifically, an arrowhead assembly for use with a bow and arrow, that allows for still accuracy and consistency in flight before imparting rotational motion of the arrowhead assembly after the arrow's impact on a target. Further, the arrowhead assembly should be capable of manufacture in a lightweight, easy-to-use, and cost-effective manner.

SUMMARY

Briefly described, in a preferred embodiment, the present invention overcomes the above-mentioned disadvantages and meets the recognized need for such a device by providing an improved arrowhead assembly design which includes curved blades of increasing width as measured from the leading edge thereof to the central axis of the arrowhead assembly. The curved blades of the arrowhead assembly provides the arrowhead assembly improved rotational motion that effectively promotes true flight, enhanced and more forceful target penetration, and stable and predictable flight path.

Additionally, a spring arrangement, retained within the arrowhead assembly, is utilized to provide rotational motion of the arrowhead assembly upon impact with a target. The spring arrangement permits independent rotation of the arrowhead assembly relative to the arrow shaft, wherein the rotation of the arrowhead assembly is preferably substantially along the longitudinal axis of the shaft.

The spring arrangement insert of the present invention preferably enables the broadhead-type arrowhead assembly to rotate at a rate during flight that is independent from the arrow shaft rotation; and, further, upon impact with the target, allows the arrowhead assembly to continue in its rotation to penetrate a substantial distance into the target. Such characteristics are facilitated by the spiral-shaped, or twisting, nature of the blades as well as the rotational motion that is imparted by the spring arrangement after compression and expansion of the spring arrangement upon impact.

Accordingly, a feature and advantage of the present invention is its ability to overcome the deficiencies in prior art arrowhead assemblies by providing an improved arrowhead assembly in accordance with the disclosure herein.

Another feature and advantage of the present invention is its ability to provide an improved arrowhead assembly having improved cutting and target penetration characteristics.

Still another feature and advantage of the present invention is its ability to provide an improved arrowhead assembly having improved flight and accuracy characteristics.

A further feature and advantage of the present invention is its ability to provide an improved arrowhead assembly having more humane effects on a game target.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description with reference to the accompanying drawing figures, in which like reference numerals denote similar structure and refer to like elements throughout, and in which.

DETAILED DESCRIPTION

In describing the preferred and selected alternate embodiments of the present invention, as illustrated in FIGS. 1-12, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
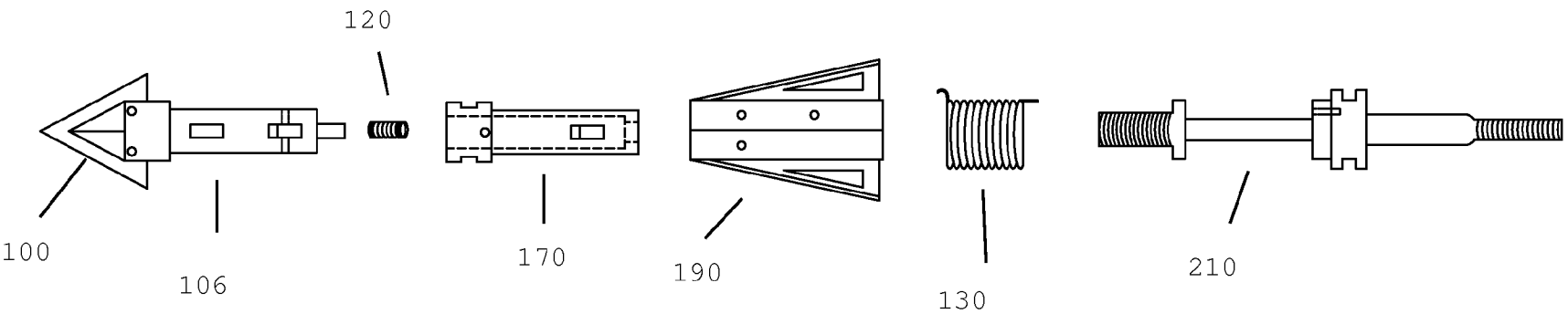
FIG. 1 is a view of a rotary arrowhead assembly in a disassembled state, according to a preferred embodiment of the present invention.
Figure 2A:
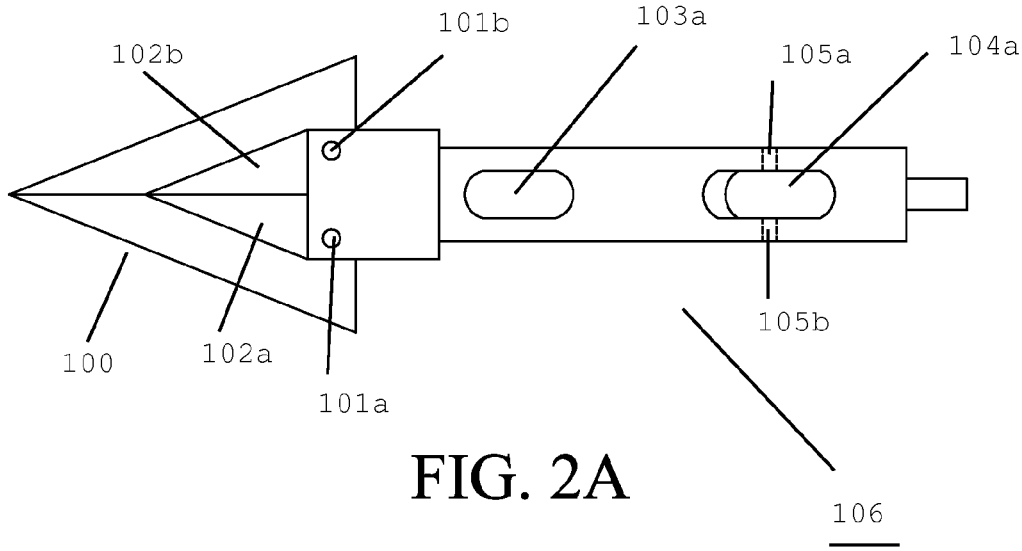
FIG. 2 is perspective views of a first blade and a cylindrical body of a rotary arrowhead assembly, according to a preferred embodiment of the present invention.
Figure 2B:
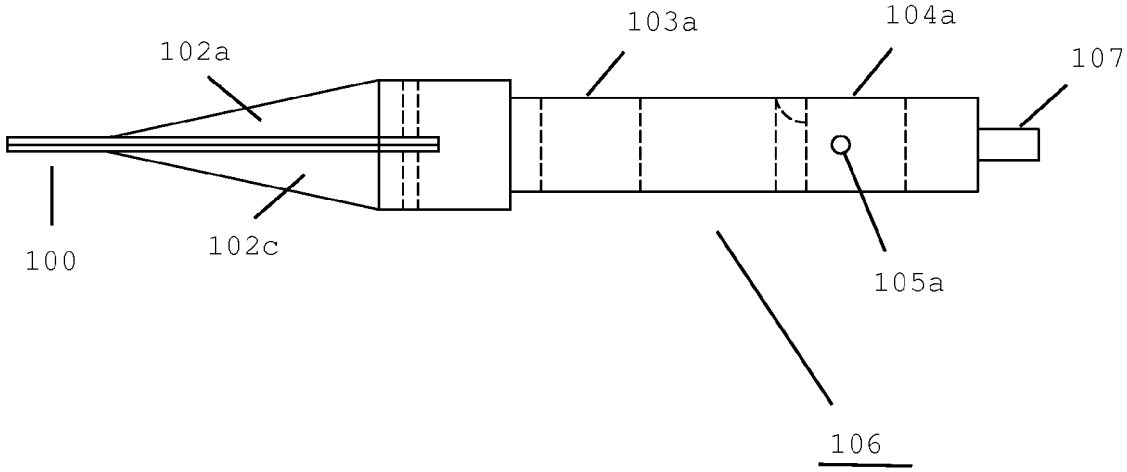
Figure 3:
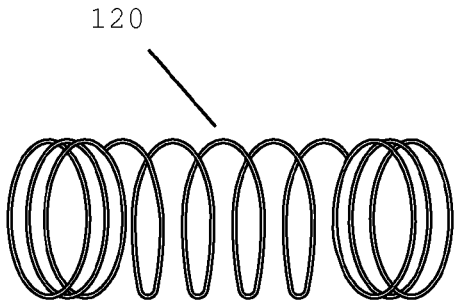
FIG. 3 is a view of a push spring of a rotary arrowhead assembly, according to a preferred embodiment of the present invention.
Figure 12:
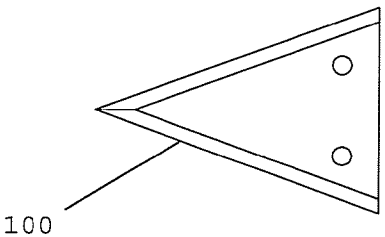
FIG. 12 is a view of a first blade of a rotary arrowhead assembly, in accordance with a preferred embodiment of the present invention.

Referring now to FIG. 2, in an embodiment, an arrowhead assembly comprises a first blade 100, which blade comprises a pointed tip that is disposed at a first end of the assembly. In use, the pointed tip is the first point of contact of the assembly with a target as the assembly impacts a target. The blade 100 further comprises a plurality of beveled regions 102*a*, 102*b*, 102*c*, and 102*d*, which regions enable the assembly to pass through the mass of a target, and in one embodiment, shatter the bone matter of a game animal. FIG. 12 shows another perspective view of a blade 100.

The first blade 100 is removably attached to a cylindrical body 106, which body comprises a first end and a second end. The first end comprises a slot capable of receiving and securing a portion of the blade 100. In an embodiment, the blade 100 is secured by roll pins 101*a* and 101*b* that project from a first and second point on the circumference of the body 106 through apertures in the blade and into a third and fourth point on the circumference of the body 106.

The cylindrical body 106 further comprises a first elongated hollow region 103*a* and a second elongated hollow region 104*a*, each of which hollow regions are oriented substantially along the longitudinal axis of the cylinder and permit passage through the entire diameter of the cylindrical body 106. The first hollow region 103*a* will be discussed in further detail in connection with FIG. 7A. The second hollow region 104*a* will be discussed in further detail in connection with FIG. 5. The second hollow region 104*a* further comprises opposing apertures 105*a* and 105*b* that extend from the interior of the cylindrical body 106 to the exterior of the cylindrical body 106. The apertures 105*a* and 105*b* are aligned in a substantially linear configuration such that a roll pin (not shown) may be inserted through the apertures, which roll pin passes through the second hollow region 104*a*.

The cylindrical body 106 further comprises a shaft 107 disposed on and extending away from the second end of the body 107. In an embodiment, the shaft 107 is cylindrical and is concentric to and of a smaller circumference than the body 106. The shaft 107 is adapted to receive a push spring 120 (shown in FIG. 3), around the circumference of the shaft 107.

Figure 4A:
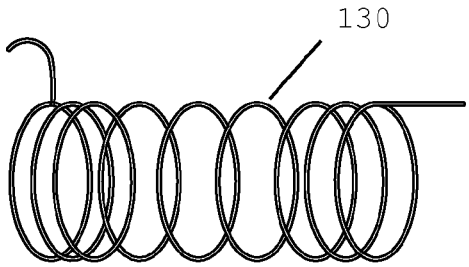
FIG. 4 is a view of a torsion spring of a rotary arrowhead assembly, in accordance with a preferred embodiment of the present invention.
Figure 4B:
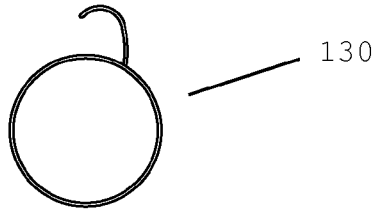

Referring to FIGS. 4A and 4B, the assembly further comprises a torsion spring 130, which spring will be described in further detail below.

Figure 5:
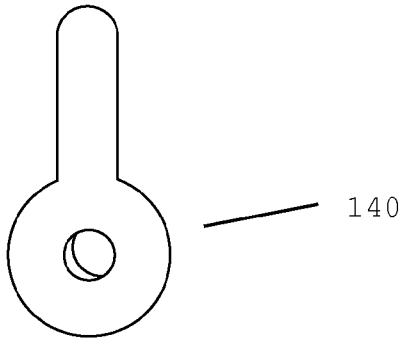
FIG. 5 is a view of a firing pin of a rotary arrowhead assembly, in accordance with an exemplary embodiment of the present invention.

Referring to FIG. 5, a firing pin 140 of an arrowhead assembly is shown. The firing pin comprises a flat ring portion and a cylindrical flange attached to and extending away from the ring portion. The firing pin 140 will be described in further detail below.

Figure 6:
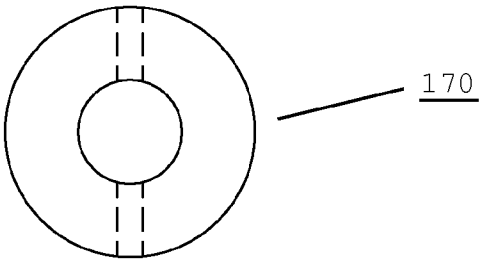
FIG. 6 is an alternate perspective view of a tubular body of a rotary arrowhead assembly, in accordance with a preferred embodiment of the present invention.
Figure 7B:
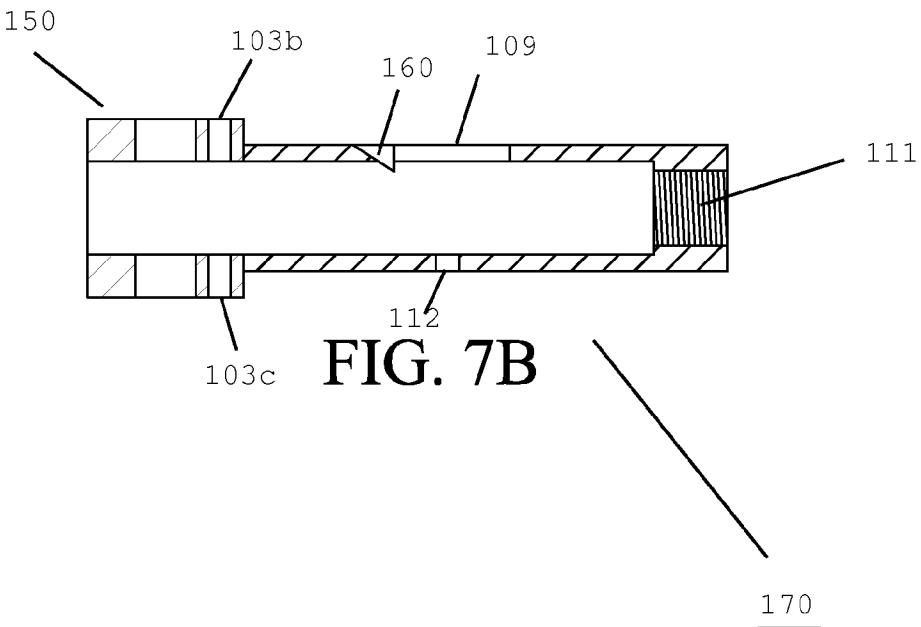
FIG. 7 is perspective views of a tubular body of a rotary arrowhead assembly, in accordance with a preferred embodiment of the present invention.
Figure 7A:
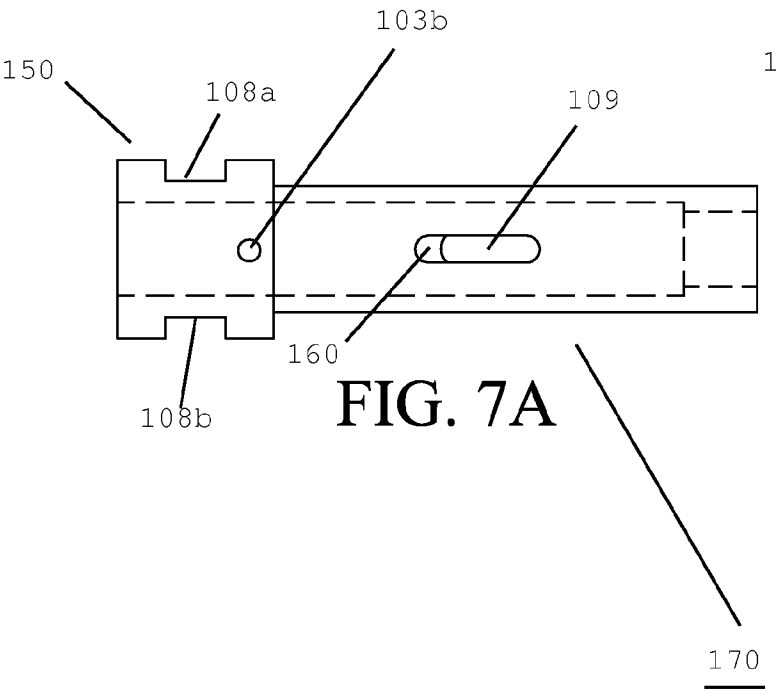

Referring now to FIGS. 6, 7A, and 7B, alternate views of a tubular body 170 of an arrowhead assembly are shown. The tubular body 170 comprises a first end, a second end, and a hollow interior portion. The first end of the tubular body includes a flange region 150 that extends along a portion of the tubular body 170 and extends away from the circumference of the tubular body 170. The flange region includes a pair of apertures 103*b* and 103*c* that are disposed linearly on opposite points of the circumference of the flange region and that are configured to accommodate a roll pin. FIG. 6 shows a perspective view of the first end of the tubular body 170, including the interior region 180, the exterior region 185, and the apertures 103*b* and 103*c*. The flange region further comprises two substantially planar regions 108*a* and 108*b* that are adjacent to the apertures and are capable of accommodating a wrench for aiding in the installation and manipulation of the assembly.

The tubular body 170 further comprises an elongate slot 109 disposed on a section of the body. The slot is parallel to the axis of the tubular body and is of a length that is approximately one fifth of the length of the body. The slot 109 is configured to accommodate the cylindrical flange of the firing pin 140 and the slot includes a shelf 160 disposed at the end of the slot that is proximate to the first end of the body. The shelf sits below the exterior surface of the tubular body and is capable of accommodating the distal end of the cylindrical flange of the firing pin 140 such that the shelf may prevent the firing pin from rotating such that the firing pin of the flange does not enter the interior of the tubular body. The interior of the second end of the tubular body 170 comprises a female threaded portion 111, the threads of which threaded portion are of a left-handed orientation, and which threads will be described in further detail below.

The tubular body 170 further comprises an access aperture 112 that is substantially opposite to the elongate slot 109. The access aperture 112 is capable of accepting an instrument (not shown) to aid in the manipulation of the assembly in a pre-firing position (to be described in detail below).

Figure 8A:
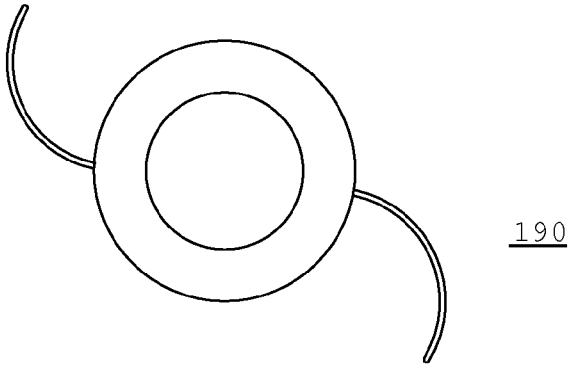
FIG. 8 is perspective views of alternate embodiments of a blade tube for a rotary arrowhead assembly, in accordance with preferred embodiments of the present invention.
Figure 8B:
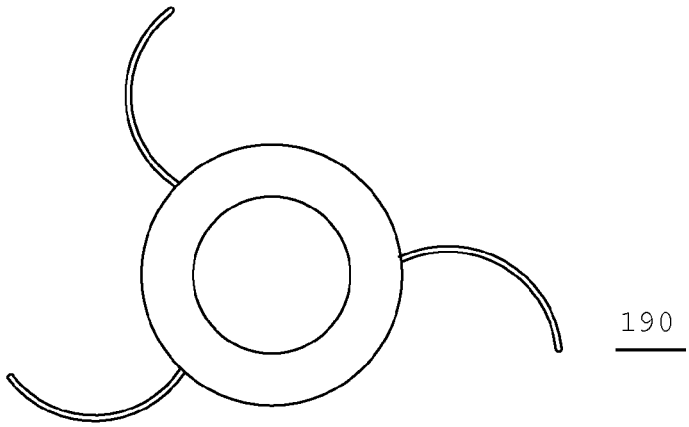
Figure 8C:
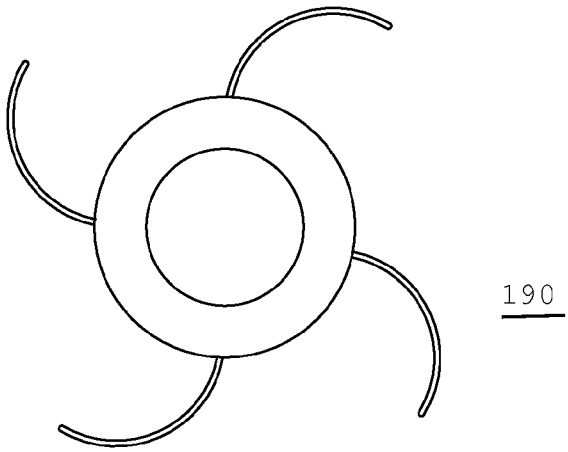
Figure 10B:
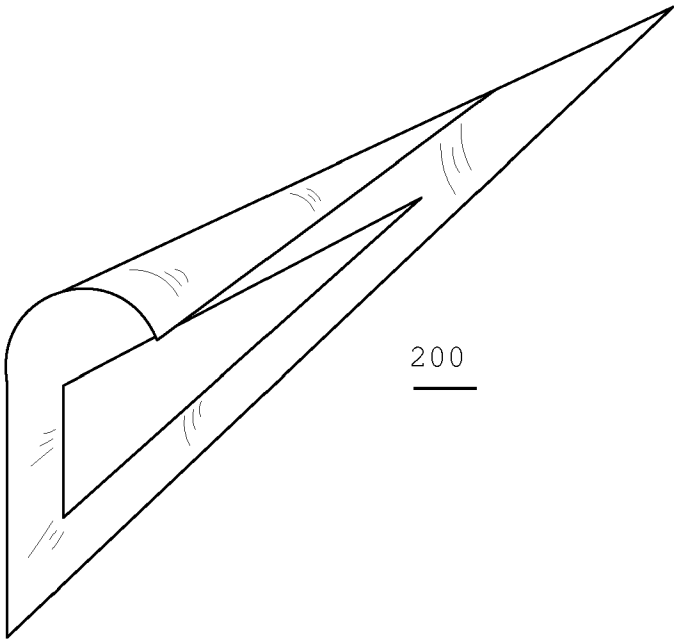
FIG. 10 is perspective views of blades and blade arrangements, in accordance with a preferred embodiment of the present invention.
Figure 10A:
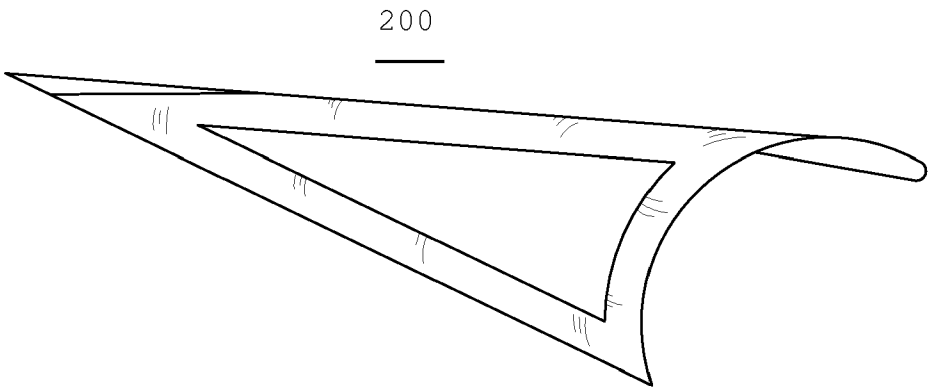

Referring to FIGS. 8A, 8B, and 8C, alternate embodiments of a blade tube 190 of an arrowhead assembly are shown. At least two blades 200 are disposed on and extend away from the blade tube 190, which blades may be substantially planar or may be curved. FIGS. 10A and 10B show perspective views of a blade of the blades 200 that extend outwardly away from blade tube 190. In an embodiment, a blade of the blades 200 comprises a cut-out portion that assists in reducing weight of the assembly. In another embodiment, the edge of a blade of the blades 200 that is distal to the tip of the assembly comprises a semi-cylindrical configuration, such that said distal edge may cause the blades to undergo a tunneling or spiral motion while passing through a target mass, which motion may reduce the resistance of the assembly's passage through the target and may increase the amount of mass of the target that is addressed by the assembly. In another embodiment, the edge of a blade of the blades that is distal to the tip of the assembly comprises a beveled region beginning at the side of the edge that is proximate to the interior of the cut-out portion and extending to the edge that is distal to the cut-out portion, which beveled region is disposed at an angle such that the region extends away from the semi-cylindrical edge of the blade. In an embodiment, the beveled region is at a 20 degree angle with respect to the flat edges of a blade.

Figure 9:
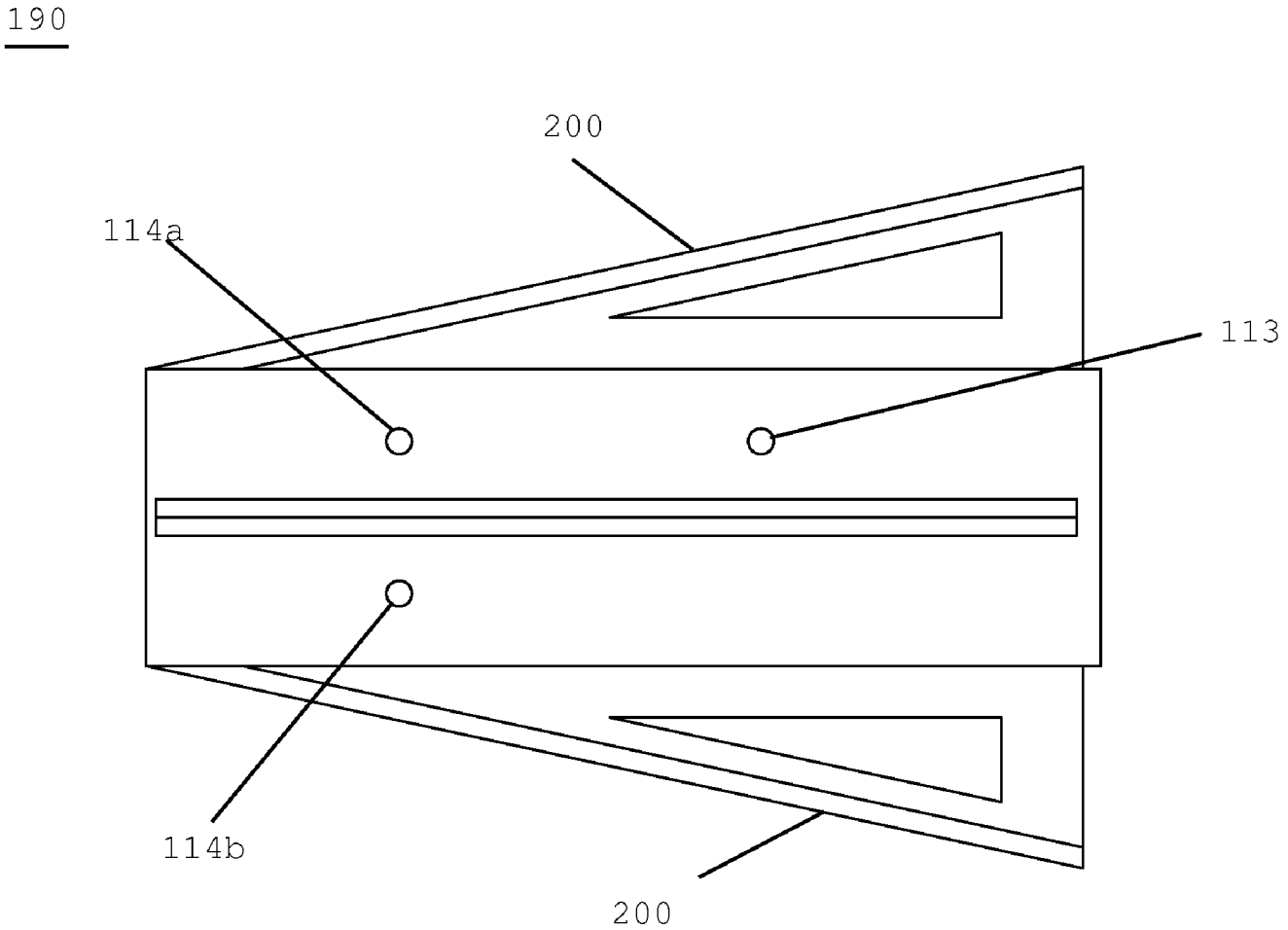
FIG. 9 is a perspective view of a blade tube with firing pin holes and a torsion spring hole, in accordance with a preferred embodiment of the present invention.

Referring now to FIG. 9, another view of blade tube 190 of an arrowhead assembly is shown. The blade tube comprises at least two blades 200 that extend outwardly away from the blade tube 190. The blade tube 190 further comprises a hollow inner portion which is capable of accommodating a torsion spring and a shaft (which shaft will be described further in connection with FIG. 11). The blade tube 190 further comprises a first torsion spring aperture 113, which is capable of accommodating an end of a torsion spring. The blade tube 190 also comprises a plurality of firing pin apertures 114, such as the apertures 114*a*, 114*b*, 114*c*, and 114*d*, which apertures 114*a* and 114*b* are disposed at substantially identical positions with regard to the distance from the tip of the assembly, and are spaced equidistant from each other along the circumference of the blade tube. In an embodiment, the blade tube comprises four firing pin apertures. With respect to the firing pin apertures 114, the first torsion spring aperture 113 is situated near the end of the blade tube that is distal to the tip of the assembly, and the firing pin apertures 114 are disposed near the end of the blade tube that is proximate to the tip of the assembly.

Figure 11:
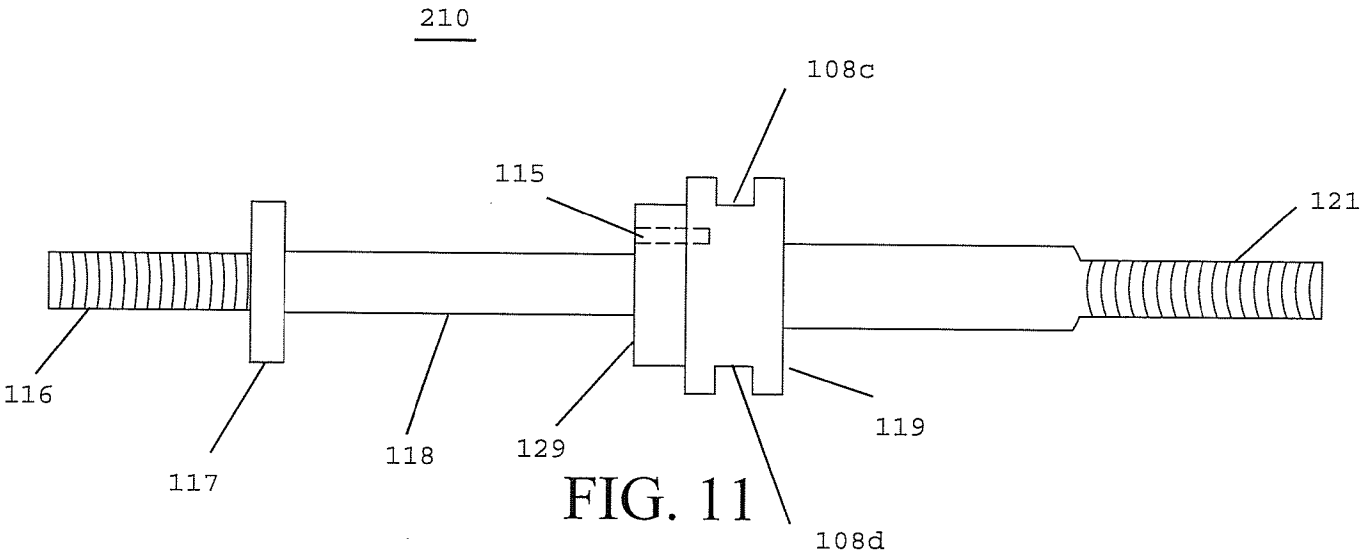
FIG. 11 is a perspective view of a coupling shaft of a rotary arrowhead assembly, in accordance with a preferred embodiment of the present invention.

Referring now to FIG. 11, a substantially cylindrical coupling shaft 210 of an arrowhead assembly is shown. The shaft 210 comprises a first end and a second end. The first end comprises a male threaded region 116, which male threaded region comprises left handed threads for coupling with the female threads 111 of the tubular body 170. At the end of the threaded region 116 that is distal to the first end of the shaft a thread stop 117 extends outwardly from the shaft, which stop 117 limits the extent of coupling of the shaft and tubular body. Disposed between the thread stop 117 and a first stop flange 119 is a mandrel 118 which is capable of insertion through the interior of and retaining a torsion spring. Disposed at approximately the midpoint of the shaft is a stop flange 119, which flange extends outwardly away from the circumference of the shaft. The flange 119 is substantially cylindrical and may comprise oppositely disposed planar regions 108*c* and 108*d* about its circumference, which planar regions 108*c* and 108*d* are capable of accommodating a wrench for aiding in the installation and manipulation of the assembly. A second torsion spring aperture 115 is disposed on the side of the flange 119 that abuts the mandrel 118, which aperture 115 extends inwardly into the flange 119 and which aperture is capable of accepting an end of a torsion spring.

The second end of the shaft comprises a male threaded portion 121, the threads of which are capable of mating with female threads of an arrow shaft known in the art to permit the assembly to securely attach to the arrow shaft to allow the assembly to be fired from a bow.

In use, the components of the assembly are put together to provide an arrowhead assembly with improved characteristics, including, but not limited to, the capability to rotate in flight and after impact.

To assemble an embodiment of assembly, the first blade 100 is inserted into the slot of the cylindrical body 106, and the blade 100 is thereafter secured to the cylindrical body by roll pins 101*a* and 101*b*. A push spring is placed onto the shaft 107 of the cylindrical body 106. A firing pin 140 is thereafter placed in the second hollow region 104*a* of the cylindrical body 106 such that the flat ring portion of the firing pin 140 is received in the second hollow region 104*a* of the cylindrical body. A roll pin may be inserted through aperture 105*a* of the cylindrical body 106, on through the ring portion of the firing pin 140, and on through aperture 105*b* of the cylindrical body to secure the firing pin 140 within the cylindrical body 106.

The tubular body 170 is thereafter slid over the cylindrical body 106 such that the apertures 103*b* and 103*c* of the tubular body 170 are aligned with the first elongated hollow region 103*a* of the cylindrical body 106, and the elongate slot 109 of the tubular body 170 is aligned with the second hollow region 104*a* of the cylindrical body 106. When the tubular body 170 and cylindrical body 106 are so situated, a user thereafter may insert a roll pin (not shown) into the aperture 103*b* of the tubular body, such that the roll pin extends from the aperture 103*b* through the hollow region 103*a* of the cylindrical body and on into the aperture 103*c* of the tubular body. In such an embodiment, the roll pin secures the cylindrical body within the tubular body.

When the cylindrical body 106 is so secured within the tubular body 170, the cylindrical flange of the firing pin 140 will extend out of the second hollow region 104*a* of the cylindrical body 106, past the shelf 160 of the elongate slot of the tubular body 170 and out of the elongate slot 109 of the tubular body 170, such that at least a portion of the cylindrical flange of the firing pin 140 protrudes out of the tubular body 170. In an embodiment, a user may position an awl, a pin, or any other similar tool through the access aperture 112 to manipulate the firing pin into the preferred orientation. In this configuration of the cylindrical body and tubular body, the firing pin may pivot such that the cylindrical flange of the pin may be positioned against the shelf of the elongate slot of the tubular body or may be positioned substantially perpendicular to the axis of the cylindrical and tubular bodies, or any point in between.

A torsion spring 130 is thereafter inserted into the hollow inner portion of the blade tube 190 such that the hooked end of the torsion spring is received in by the torsion spring aperture 113 of the blade tube 190. In this embodiment, the hooked end of the torsion spring 130 extends through the aperture 113 and outwardly away from the blade tube 190, with a substantial portion of the remaining length of the torsion spring being contained within the blade tube 190. In this embodiment, after attachment of the torsion spring 130, the blade tube 190 is slid over the tubular body 170 such that the tubular body is accepted within a portion of the hollow inner portion of the blade tube 190 and such that the firing pin apertures 114 of the blade tube 190 are proximate to the blade end of the assembly.

In this embodiment, the coupling shaft 210 is thereafter slid into the blade tube such that the shaft 210 and mandrel 118 pass through the interior of the torsion spring until the substantially straight end of the torsion spring is received in the second torsion spring aperture 115 of the stop flange of the coupling shaft 210.

Within the blade tube 190, the threaded end of coupling shaft 210 is thereafter disposed against the corresponding threaded end of the tubular body 170, and the threaded portions thereof are mated for attachment of the coupling shaft 210 to the tubular body 170. In this attached configuration of the coupling shaft and the tubular body, the torsion spring and mandrel are received within the hollow portion of the blade tube 190 such that blade tube 190 covers the full length of the torsion spring. In this embodiment, the firing pin apertures 114 of the blade tube 190 may be substantially aligned with the cylindrical flange of the firing pin 140, when the flange extends upwardly out of the cylindrical body 106 and tubular body 170.

Further in this embodiment, the diameter of the tubular assembly corresponds to the diameter of inner hollow portion of the blade tube to allow the blade tube to rotate freely about the tubular body and to prevent the blade tube from moving in any other vector with respect to the stop flange.

With the hooked end of the torsion spring inserted in to the first torsion spring aperture 113 of the blade tube, the blade tube is operatively coupled with the torsion spring. In this embodiment, the blade tube may be rotated such that the torsion spring is compressed and mechanical energy is stored therein. After the blade tube 190 is so rotated to the user's preference, the firing pin may be inserted through a firing pin aperture 114 of the blade tube to secure the blade tube in place around the tubular body 170.

In this embodiment, the end of the blade tube 190 that is proximate to the tip end of the assembly sits flush against the flange region 150 of the tubular body 170, and the end of the blade tube that is distal to the tip end of the assembly sits flush against the first stop flange 119 of the coupling shaft 210. In an embodiment, a second stop flange 129 that is concentric the first stop flange of the coupling shaft extends away from the distal end of the coupling shaft 210 and into the blade tube 190, the diameter of which second stop flange corresponds to the diameter of inner hollow portion of the blade tube to allow the blade tube to rotate freely about the second stop flange and to prevent the blade tube from moving in any other vector with respect to the stop flange.

Before use, the male threaded portion 121 of the coupling shaft are mated with corresponding female threads of an arrow shaft (not shown) to permit the assembly to securely attach to the arrow shaft and to allow the assembly to be fired from a bow.

In use after assembly, the assembly may be fired from a bow. In flight, the assembly may rotate to improve aerodynamics and accuracy. Upon impact, the force of the impact causes the firing pin to move from its outwardly-projecting position to a position where its flange is disposed on the shelf of the elongate slot 109 of the tubular member 170. In this position, the firing pin ceases its restriction of the rotation of the blade tube 190, and the torsion spring thereafter imparts rotational motion upon the blade tube such that the blade tube rotates around the tubular member and about the longitudinal axis of the assembly. The rotational motion of the blade tube, combined with the configuration of the blades disposed on the blade tube, causes a boring effect inside the target after impact of the assembly upon the target. The boring effect improves the ease of passage of the assembly through the target as compared to existing arrowheads and arrow shafts, and, as further compared to existing arrowheads and arrow shafts, may cause a larger diameter and volume of the target's mass to be disrupted or removed upon passage of the assembly through the target. As a result, the assembly provides for a higher probability that a game target will be killed due to impact and passage therethrough of the assembly. This is as contrasted to the case of known arrowheads and arrow shafts, which may leave a small diameter of interruption after passing through a target, the result of which may not immediately kill a game target and may instead result in the target slowly bleeding to death.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. A rotary arrowhead assembly for impacting on a target, the assembly comprising a first blade comprising a tip,
a cylindrical body,
a tubular body,
a firing pin,
a blade tube comprising at least one blade extending away from said blade tube,
a torsion spring,
a push spring,
a plurality of roll pins, and
a coupling shaft,
wherein said first blade is removably attached to said cylindrical body and is secured to said cylindrical body by way of at least two roll pins,
wherein said cylindrical body is removably coupled to and received within said tubular body,
wherein said firing pin is removably secured within said cylindrical and tubular bodies and within said blade tube in the assembly before impact of the assembly upon a target,
wherein said cylindrical and said tubular bodies as removably coupled to one another are received in a hollow inner portion of said blade tube,
wherein said blade tube is retained on the assembly by said tubular body and by said coupling shaft,
wherein said torsion spring is compressed within said blade tube during before impact, and
wherein said blade tube is precluded from rotating about said cylindrical and tubular bodies before impact.

2. The rotary arrowhead assembly of claim 1, wherein after impact with a target said torsion spring decompresses and wherein said firing pin is dislodged from said tubular body and said blade tube,
whereby said decompression of said torsion spring and said dislodging of said firing pin allows said blade tube to rotate about said cylindrical and said tubular bodies after impact with a target.

3. The rotary arrowhead assembly of claim 1, wherein said assembly is comprised of titanium.

4. The rotary arrowhead assembly of claim 1, wherein said assembly is composed of aluminum.

5. The rotary arrowhead assembly of claim 1, wherein said assembly is capable of being attached to an arrow shaft.

6. The rotary arrowhead assembly of claim 1, wherein the first blade further comprises a plurality of beveled regions.

7. The rotary arrowhead assembly of claim 1, wherein said cylindrical body comprises
a first elongated hollow region;
a second elongated hollow region, and
a shaft,
and wherein said second hollow region further comprises opposing apertures.

8. The rotary arrowhead assembly of claim 1, wherein said tubular body comprises
a first end,
a second end,
a hollow interior portion,
an elongate slot disposed parallel to the axis of the tubular body, and
an access aperture;
wherein said first end of the tubular body further comprises a flange region that surrounds and extends away from the tubular body,
wherein said flange further comprises a pair of oppositely-disposed apertures situated on the circumference of the flange, which apertures are capable of accommodating a roll pin, and wherein said flange further comprises at least two substantially planar regions that are adjacent to said apertures;

wherein said elongate slot further comprises a shelf disposed at the end of said slot that is proximate to said first end of said tubular body;

wherein said second end of said tubular body further comprises a female threaded portion; and wherein said access aperture is disposed substantially opposite to said elongate slot.

9. The rotary arrowhead assembly of claim 1, wherein said blade tube comprises a hollow inner portion, a first torsion spring aperture, and a plurality of firing pin apertures;

wherein said torsion spring aperture is capable of receiving an end of a torsion spring, and wherein said plurality of firing pin apertures are capable of receiving at least a portion of a firing pin.

10. The rotary arrowhead assembly of claim 1, wherein said coupling shaft comprises a first end, a second end, a stop flange, a mandrel, and a second torsion spring aperture;

wherein said first end further comprises a male threaded region, wherein said second end further comprises a male threaded region, wherein said thread stop extends outwardly from said shaft, wherein said stop flange is substantially circular and is disposed at the midpoint of said shaft, wherein said flange further comprises at least two oppositely disposed planar regions on the circumference of said flange;

wherein said mandrel is disposed between said thread stop and said flange; and wherein said torsion spring aperture is disposed on the side of said flange that is proximate to said mandrel, said aperture capable of receiving an end of a torsion spring.

11. The rotary arrowhead assembly of claim 1, wherein said cylindrical body comprises a push spring disposed on said shaft of said cylindrical body.

* * * * *